US011122661B2

(12) United States Patent
Nian et al.

(10) Patent No.: US 11,122,661 B2
(45) Date of Patent: Sep. 14, 2021

(54) DRIVER, CONTROLLING METHOD AND ILLUMINATION SYSTEM

(71) Applicant: DELTA ELECTRONICS, INC., Taoyuan (TW)

(72) Inventors: Chia-Jung Nian, Taoyuan (TW); Wei-Cheng Chiu, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 120 days.

(21) Appl. No.: 16/560,956

(22) Filed: Sep. 4, 2019

(65) Prior Publication Data

US 2020/0267808 A1 Aug. 20, 2020

(30) Foreign Application Priority Data

Feb. 15, 2019 (CN) ..... 201910116852.X

(51) Int. Cl.
*H05B 45/37* (2020.01)
*H05B 45/10* (2020.01)

(52) U.S. Cl.
CPC ..... *H05B 45/37* (2020.01); *H05B 45/10* (2020.01)

(58) Field of Classification Search
CPC ..... H05B 45/10; H05B 45/37
See application file for complete search history.

(56) References Cited

U.S. PATENT DOCUMENTS

2013/0043792 A1* 2/2013 Reed ..... H05B 45/50 315/126
2016/0316532 A1* 10/2016 Kim ..... H05B 45/10

* cited by examiner

*Primary Examiner* — Alexander H Taningco
*Assistant Examiner* — Pedro C Fernandez
(74) *Attorney, Agent, or Firm* — CKC & Partners Co., LLC

(57) ABSTRACT

A driver for driving a load unit includes a conversion circuit, a bypass circuit and control circuit. The conversion circuit is configured for converting an input voltage into an output voltage, in which the load unit is coupled to the conversion circuit to receive the output voltage and an output current. The bypass circuit is electrically coupled to the conversion circuit and the load unit. The control circuit controls the output current to flow through the load unit to drive the load unit in a driving mode. The control circuit controls the output current to flow through the bypass circuit in a standby mode, in which the output current in the standby mode is lower than the output current in the driving mode.

20 Claims, 5 Drawing Sheets

DRIVER, CONTROLLING METHOD AND ILLUMINATION SYSTEM

CROSS-REFERENCE TO RELATED APPLICATION

This application claims priority to China Application Serial Number 201910116852.X, filed Feb. 15, 2019, which is herein incorporated by reference in its entirety.

BACKGROUND

Technical Field

The present disclosure relates to a driver and a control method, and in particular to a drive circuit and a control method for controlling a load unit.

Description of Related Art

Since the awareness of energy conservation has risen gradually, many electronic devices may enter a sleep mode or a standby mode on the condition of inactivity for a long time. When operating in the sleep mode or the standby mode, many electronic components in the electronic device are turned off, but some electronic components (such as processor, memory, etc.) are still required to be continuously powered on, in order to immediately resume operation(s) of the electronic device when being awakened. Compared with turning off the entire electronic device (i.e., all components are powered off) so that re-operating the electronic device requires rebooting the electronic device and waiting all components to be reactivated, operation(s) of the standby mode or the sleep mode have the advantages of energy saving and easy operation.

Generally, when lighting equipment operates in the standby mode, the power conversion circuit continues to supply power to some electronic components (such as processor). However, such behavior results in continuous generation of output current to light emitting elements. For the purpose of achieving the standby mode, a related art employs an additional circuit (such as an auxiliary winding) to bypass the power provided from the power conversion circuit to the processor for intelligent control. However, the complexity of overall circuit is thus increased.

SUMMARY

An aspect of the present disclosure relates to a driver for driving a load unit, and the driver includes a conversion circuit, a bypass circuit, and a control circuit. The conversion circuit is configured to convert an input voltage into an output voltage, in which the load unit is coupled to the conversion circuit to receive the output voltage and an output current. The bypass circuit is electrically coupled between the conversion circuit and the load unit. The control circuit is configured to control the output current to flow through the load unit to drive the load unit in a driving mode, and to control the output current to flow through the bypass circuit in a standby mode, in which the output current in the standby mode is lower than the output current in the driving mode.

An aspect of the present disclosure relates to a control method for a load unit, and the control method includes the following operations: providing, by a conversion circuit, an output current and an output voltage; selectively operating, by a control unit, a load unit to be in a driving mode or in a standby mode according to a control signal; in the driving mode, controlling the output current to flow through the load unit, in order to drive the load unit; and in the standby mode, controlling the output current to flow through a bypass circuit connected in parallel with the load unit, in which the output current in the standby mode is lower than the output current in the driving mode.

An aspect of the present disclosure relates to an illumination system that includes an illumination unit and a driver. The driver for driving the illumination unit, the driver includes a conversion circuit, a bypass circuit, and a control circuit. The conversion circuit is configured to convert an input voltage into an output voltage, in which the illumination unit is coupled to the conversion circuit to receive the output voltage and an output current. The bypass circuit is electrically coupled between the conversion circuit and the illumination unit. The control circuit is configured to control the output current to flow through the illumination unit to drive the illumination unit in a driving mode, and to control the output current to flow through the bypass circuit in a standby mode, in which the output current in the standby mode is lower than the output current in the driving mode.

As described above, the driver and the control method in embodiments of the present disclosure are able to supply power to a microprocessor by providing the output voltage directly or providing the coupling output voltage without employing additional circuits. The low power consumption of the standby mode can be achieved by simple circuit operations, and thus reducing the complexity and cost of the overall circuit.

DETAILED DESCRIPTION

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Figure 1:
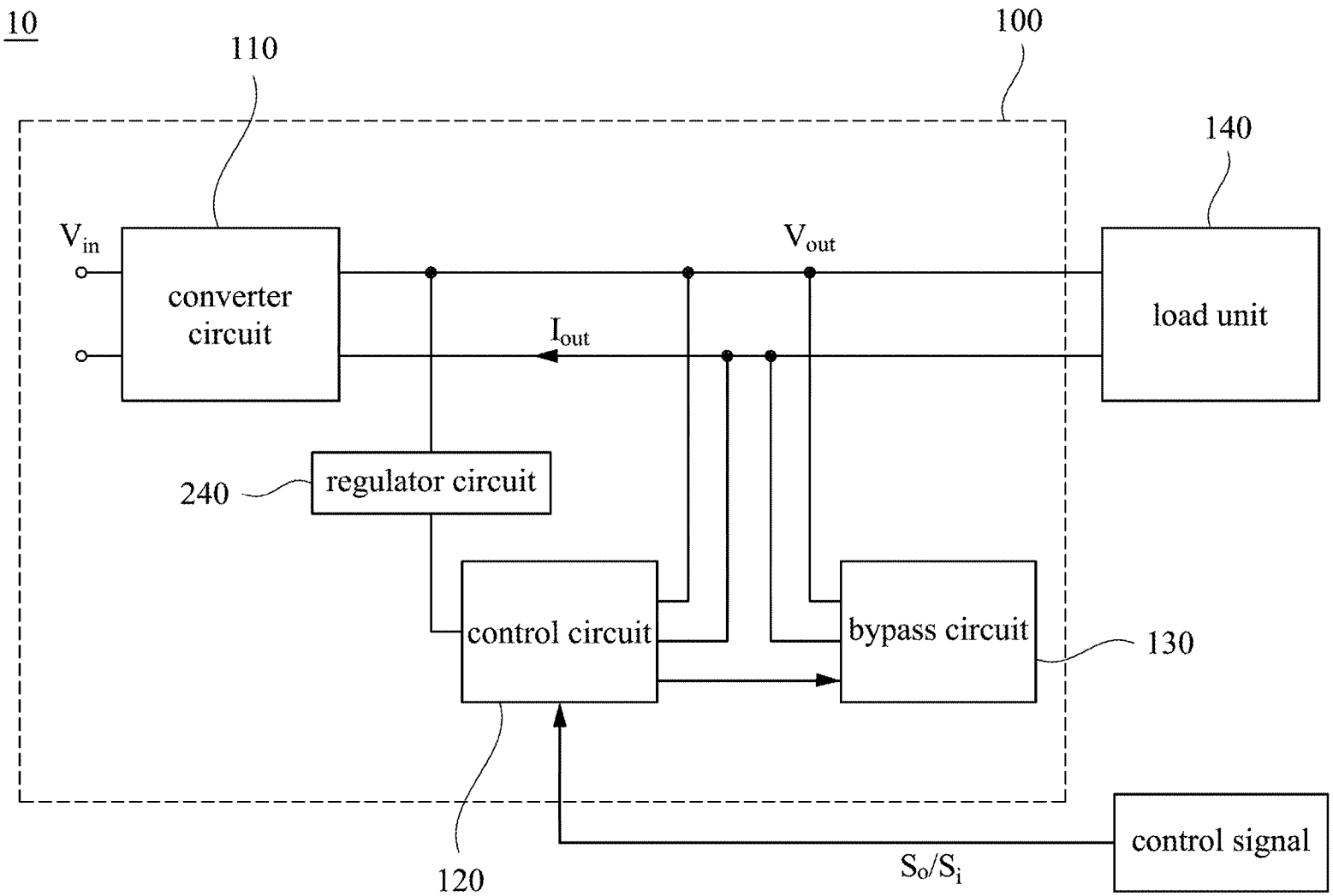
FIG. 1 shows a schematic diagram of an electronic device according to some embodiments of the present disclosure.

Referring to FIG. 1, FIG. 1 is a schematic diagram of an electronic device 10 according to some embodiments of the present disclosure. The electronic device 10 includes a driver 100 and a load unit 140. The driver 100 is configured to drive the load unit 140, and can adjust the value of the current supplied to the load unit 140 according to practical condition(s), thereby adjusting the state of the load unit 140. In some embodiments, the electronic device 10 can be an illumination system. The load unit 140 can be a light emitting diode (e.g., light emitting diode string, light emitting diode array, etc.) or other light emitting elements (e.g., fluorescent lamp, incandescent light bulb, halogen lamp, etc.). The driver 100 can adjust the current supplied to the light emitting element according to practical condition(s), thereby adjusting the brightness of the light emitting element. In other embodiments, the load unit 140 may be not limited to the light emitting elements, and may be other current driven products (e.g., a motor). The driver 100 can adjust the current supplied to the motor according to practical condition(s), thereby adjusting its rotation speed. For illustrative purposes, the following embodiments are given with reference to examples where the load unit 140 is a light emitting diode, but the present disclosure is not limited thereto.

The driver 100 includes a conversion circuit 110, a control circuit 120, and a bypass circuit 130. The conversion circuit 110 is configured to convert an input voltage $V_{in}$ into an output voltage $V_{out}$. The load unit 140 is powered on by a part of the output voltage $V_{out}$, and the control circuit 120 and/or other components are powered on by other part of the output voltage $V_{out}$. In other embodiments, the conversion circuit 110 can be a switching power converter that includes a DC to DC architecture or AC to DC architecture. For example, the conversion circuit 110 can include, but not limited to, a buck converter, a boost converter, a forward converter, a buck-boost converter, a half-bridge converter, a full-bridge converter, a flyback converter, and/or the like.

The bypass circuit 130 is electrically connected between the conversion circuit 110 and the load unit 140, and determines whether to be conducted (or be turned on) according to operation(s) of the control circuit 120.

The control circuit 120 can control the driver 100 to be in a driving mode or a standby mode. In some embodiments, the control circuit 120 can determine the driver 100 to enter the driving mode or the standby mode according to the control signal. The control signal includes an external signal $S_o$ and/or an internal signal $S_i$. The external signal $S_o$ may be a command signal sent from the outside of the electronic device 10, but is not limited thereto. For example, a user can send a dimming command or a standby command to the control circuit 120 via remote control, touch control, etc. according to practical requirements, so as to control the driver 100 to enter the driving mode or the standby mode. The internal signal $S_i$ may be any signal from the internal components of the electronic device 10, but is not limited thereto. For example, the control circuit 120 can sense the input voltage $V_{in}$ received by the conversion circuit 110, and determine the driver 100 to enter the driving mode or the standby mode by comparing the input voltage $V_{in}$ with a reference voltage. For example, the driver 100 enters the driving mode when the input voltage $V_{in}$ is greater than or equal to the reference voltage, and the driver 100 enters the standby mode when the input voltage $V_{in}$ is less than the reference voltage.

In the driving mode, the control circuit 120 cuts off (or turns off) the bypass circuit 130 so that the output current $I_{out}$ flows through the load unit 140, and adjusts the values of the output current $I_{out}$ and the output voltage $V_{out}$ to adjust the brightness of the load unit 140 (e.g., light emitting diode). In the standby mode, the control circuit 120 turns on the bypass circuit 130 and reduces the output current $I_{out}$ and the output voltage $V_{out}$, so that the output current $I_{out}$ flows through the turned-on bypass circuit 130 rather than the load unit 140. In other words, in the standby mode, the control circuit 120 still controls the conversion circuit 110 to continuously supply the output current $I_{out}$ and the output voltage $V_{out}$, so as to provide the output voltage $V_{out}$ for supplying power.

Generally, in the standby mode, the control component of the electronic device 10 typically controls the conversion circuit 110 to stop converting the input power into the output power, or to convert the input power into zero output power, so as to stop providing voltage and/or current to the load unit 140. However, different from turning off the entire electronic device, some components (e.g., control components, memory components, etc.) in the electronic device 10 still require to be powered on, in order to be activated when the electronic device 10 is awakened (unlike booting up). Under this situation, the control component and some components need other conversion circuits or auxiliary windings to convert the output power into the power required by these components. On the contrary, since the bypass circuit 130 is employed in the electronic device 10 in the embodiments of the present disclosure, on the condition of stopping supplying the output current $I_{out}$ to the load unit 140, the control circuit 120 is able to be powered on by the same conversion circuit 110 without employing additional conversion circuit or auxiliary winding in the standby mode.

Figure 2:
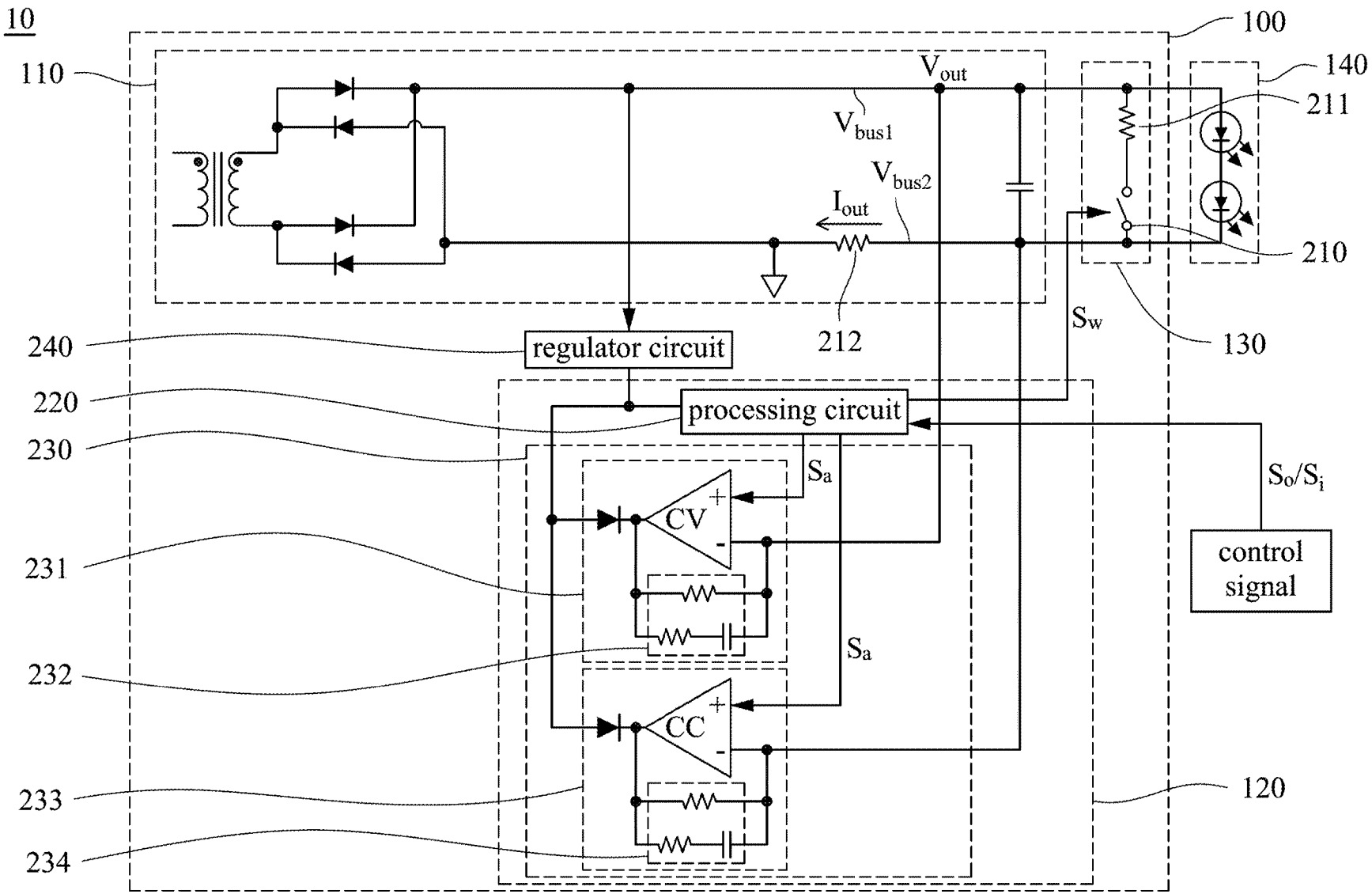
FIG. 2 shows a circuit diagram of a driver according to some embodiments of the present disclosure.

Referring to FIG. 2, FIG. 2 is a circuit diagram of a driver according to some embodiments of the present disclosure. In some embodiments, a primary side of the conversion circuit 110 includes a set of primary windings. A secondary side of the conversion circuit 110 includes two sets of secondary windings, in which a beginning terminal of one secondary winding is electrically coupled to an end terminal of the other secondary winding. For example, in some embodiments, the conversion circuit 110 can be a secondary side center tapped transformer, so that the secondary side of the conversion circuit 110 is separated into a first secondary winding and a second secondary winding coupled to each other. In some embodiments, the conversion circuit 110 can also be a transformer with only one set of secondary windings on the secondary side, and operates with a full-bridge rectifier circuit. The secondary side and the rectifier circuit can be implemented with various circuit architectures known by those skilled in the art.

In some embodiments, the control circuit 120 includes a processing circuit 220 and an adjustment circuit 230. The processing circuit 220 is configured to receive the control signal (any one of the external signal $S_o$ or the internal signal $S_i$), and output an adjustment signal $S_a$ to the adjustment circuit 230 and output a switching signal $S_w$ to the bypass circuit 130 according to the control signal. The adjustment circuit 230 adjusts the output voltage $V_{out}$ and/or the output current $I_{out}$ supplied to the load unit 140 according to the adjustment signal $S_a$. The bypass circuit 130 is turned on or off according to the switching signal $S_w$.

When an indication of entering the driving mode is given by the control signal, the processing circuit 220 generates a corresponding adjustment signal $S_a$ according to the desired output voltage $V_{out}$ and/or the output current $I_{out}$ indicated by the control signal. The adjustment circuit 230 adjusts the output voltage $V_{out}$ and/or the output current $I_{out}$ supplied to the load unit 140 according to the adjustment signal $S_a$ to meet the requirement of the control signal. In addition, the processing circuit 220 further outputs the switching signal $S_w$ to turn off (i.e., cut off) the bypass circuit 130, so that the output current $I_{out}$ is allowed to supply to the load unit 140.

When an indication of entering the standby mode is given by the control signal, the processing circuit 220 generates a corresponding adjustment signal $S_a$. According to the adjustment signal $S_a$, the adjustment circuit 230 reduces the output voltage $V_{out}$ and/or the output current $I_{out}$ to the minimum enough to supply the power the control circuit 120 and/or other components require. In addition, the processing circuit 220 further outputs the switching signal $S_w$ to turn on the bypass circuit 130, so that the output current $I_{out}$ flows through the bypass circuit 130 rather than the load unit 140.

In other words, when the driver 100 is operated in the standby mode, there is no output current $I_{out}$ flowing to the load unit 140, but the output voltage $V_{out}$ is not zero so that this voltage is able to supply to the control circuit 120 and/or other components. In other words, whether the driver 100 is operated in the standby mode or the driving mode, the output voltage $V_{out}$ will not be zero.

In some embodiments, the adjustment circuit 230 is coupled to the processing circuit 220 to receive a voltage adjustment signal (that is, the adjustment signal $S_a$ transmitted to a first operation circuit 231 as described below) and a current adjustment signal (that is, the adjustment signal $S_a$ transmitted to a second operation circuit 233 as described below). The adjustment circuit 230 is configured to adjust the output voltage $V_{out}$ according to the voltage adjustment signal, and to adjust the output current $I_{out}$ according to the current adjustment signal.

In some embodiments, the adjustment circuit 230 includes a first operation circuit 231 and a second operation circuit 233, in which the first operation circuits 231 and the second operation circuits 233 can adjust the output voltage $V_{out}$ and the output current $I_{out}$ through a negative feedback mechanism.

In some embodiments, the first operation circuit 231 includes an operational amplifier CV and a group of impedance components 232. A first input end of the operational amplifier CV is connected to the processing circuit 220, and is configured to receive the voltage adjustment signal from the processing circuit 220. A second input end of the operational amplifier CV is connected to a first power line $V_{bus1}$ connected to an output end and configured to receive the voltage on the first power line $V_{bus1}$, and is connected to the output end of the operational amplifier CV via the group of impedance components 232 to form the negative feedback path. Accordingly, when the voltage adjustment signal is changed, the operational amplifier CV can adjust the voltage on the first power line $V_{bus1}$ to be equal to the voltage indicated by the changed voltage adjustment signal, thereby adjusting the output voltage $V_{out}$.

In some embodiments, the second operation circuit 233 includes an operational amplifier CC and a group of impedance components 234. A first input end of the operational amplifier CC is connected to the processing circuit 220, and is configured to receive a current adjustment signal from the processing circuit 220. The second input end of the operational amplifier CC is connected to the second power line $V_{bus2}$ connected to the output end and configured to receive the voltage on the second power line $V_{bus2}$, and is connected to the output end of the operational amplifier CC via the group of impedance components 234 to form the negative feedback path. Specifically, a resistor 212 is arranged on the second power line $V_{bus2}$. The first end of the resistor 212 is grounded and the second end of the resistor 212 is connected to the second input end of the operational amplifier CC. When the current adjustment signal is changed, the operational amplifier CC can adjust the voltage on the second power line $V_{bus2}$ to be equal to the voltage indicated by the changed current adjustment signal. Since the value of the resistor is fixed and the first end is grounded, the output current $I_{out}$ can be further adjusted by adjusting the voltage on the second power line $V_{bus2}$.

In some embodiments, the driver 100 further includes a regulator circuit 240 which is coupled to the first power line $V_{bus1}$. The regulator circuit 240 is configured to receive the output voltage $V_{out}$ and to adjust the output voltage $V_{out}$ in order to generate a supply voltage for driving the control circuit 120.

In some embodiments, the load unit 140 of FIG. 2 includes two or more light emitting diodes that are connected in series or in parallel with each other for emitting light having a corresponding brightness according to a value of the output current $I_{out}$.

In some embodiments, the bypass circuit 130 includes a switch 210 and a resistor 211 that are connected in series. The switch 210 is controlled to be turned on or off according to the switching signal $S_w$. Specifically, the value of the resistor 211 is set to be smaller than a result of dividing the output voltage $V_{out}$ by the value of the output current $I_{out}$ in the standby mode, so that the entire output current $I_{out}$ can flow through the bypass circuit 130 when the bypass circuit 130 is turned on.

Figure 3:
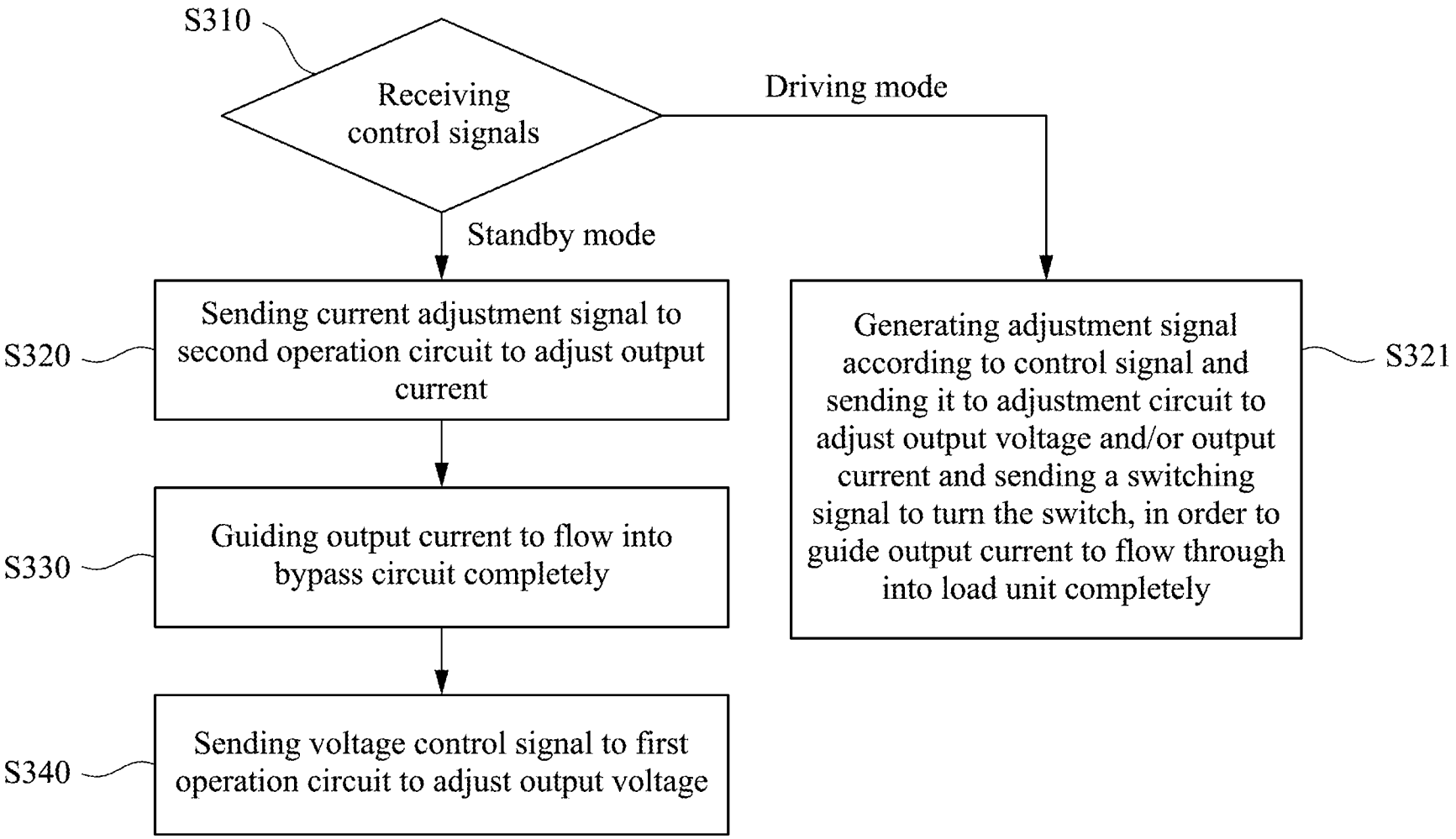
FIG. 3 shows a flow chart of a control method according to some embodiments of the present disclosure.

Referring to FIG. 3, FIG. 3 is a flow chart of a control method according to some embodiments of the present disclosure. For ease understanding, reference is also made to the above FIG. 1 and FIG. 2. In some embodiments, the control method can be applied with the standby mode and the driving mode of the driver 100, and thus achieving standby low power consumption and reducing overall circuit complexity. The individual operations in the control method are merely examples, and are not limited to be performed in the order in this example. Various operations of the control method may be appropriately added, replaced, omitted, or performed in a different order, without departing from the operation and scope of the embodiments of the present disclosure.

In operation S310, the processing circuit 220 determines whether to switch the driver 100 to be in the standby mode or the driving mode according to the control signal. If the standby mode is determined, operation S320 is performed. If driving mode is determined, operation S321 is performed.

In operation S321, the processing circuit 220 generates an adjustment signal and sends the same to the adjustment circuit 230 for adjusting the output voltage $V_{out}$ and/or the output current $I_{out}$ according to the control signal. The processing circuit 220 sends a switching signal to turn off the switch 210, so that the output current $I_{out}$ flows through into the load unit 140 completely.

In operation S320, the processing circuit 220 switches the driver 100 to be in the standby mode according to the control signal. Afterwards, the processing circuit 220 sends a current adjustment signal to the second operation circuit 233 to adjust the output current $I_{out}$. The practical implementations can be understood with reference to the above embodiments, and thus the repetitious description is not further given described herein.

In operation S330, the processing circuit 220 sends a switching signal to turn on the switch 210, so that the output current $I_{out}$ flows into the bypass circuit 130 completely.

In operation S340, the processing circuit 220 sends a voltage control signal to the first operation circuit 231 to adjust the output voltage $V_{out}$. The practical implementations can be understood with reference to the above embodiments, and thus the repetitious description is not further given described herein.

In the standby mode, the first operation circuit 231 lowers the output voltage $V_{out}$ but not to zero (that is, in some embodiments, the output voltage $V_{out}$ is not less than the required voltage for the normal operation of the control circuit 120), so that the output voltage $V_{out}$ is continuously supplied to the regulator circuit 240, and the regulator circuit 240 generates a supply voltage to power on the control circuit 120.

Figure 4:
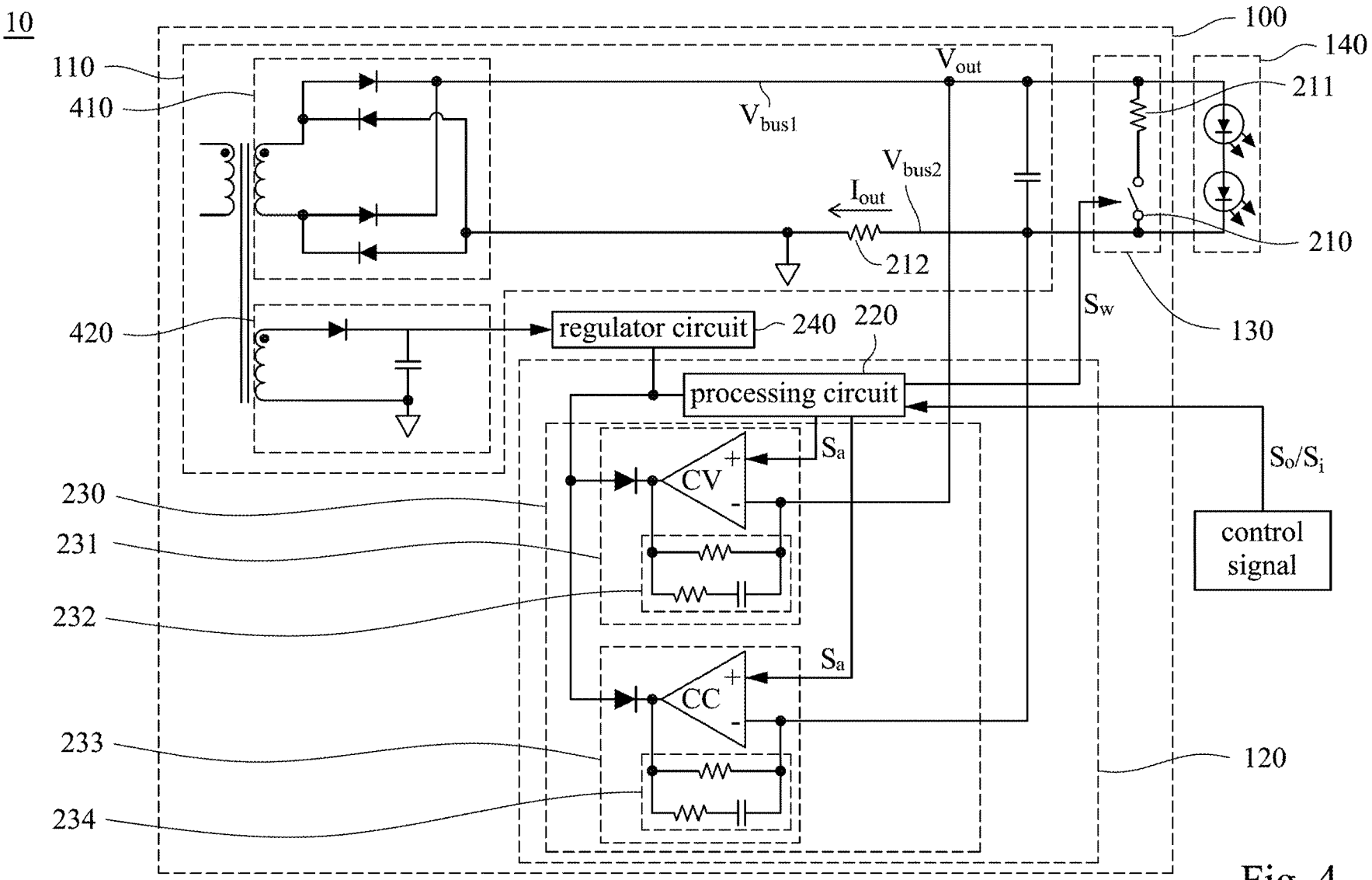
FIG. 4 shows a circuit diagram of the second type of the driver according to some embodiments of the present disclosure.

Referring to FIG. 4, FIG. 4 is a circuit diagram of the second type of the driver according to some embodiments of the present disclosure. In this example the conversion circuit 110 further includes a first secondary winding 410 and a second secondary winding 420.

In some embodiments, the conversion circuit 110 outputs the output voltage $V_{out}$ and the output current $I_{out}$ via the first secondary winding 410 to drive the load unit 140 (e.g., LED), and outputs a first voltage to the regulator circuit 240 via the second secondary winding 420, in order to generate a supply voltage to drive the control circuit 120.

Figure 5:
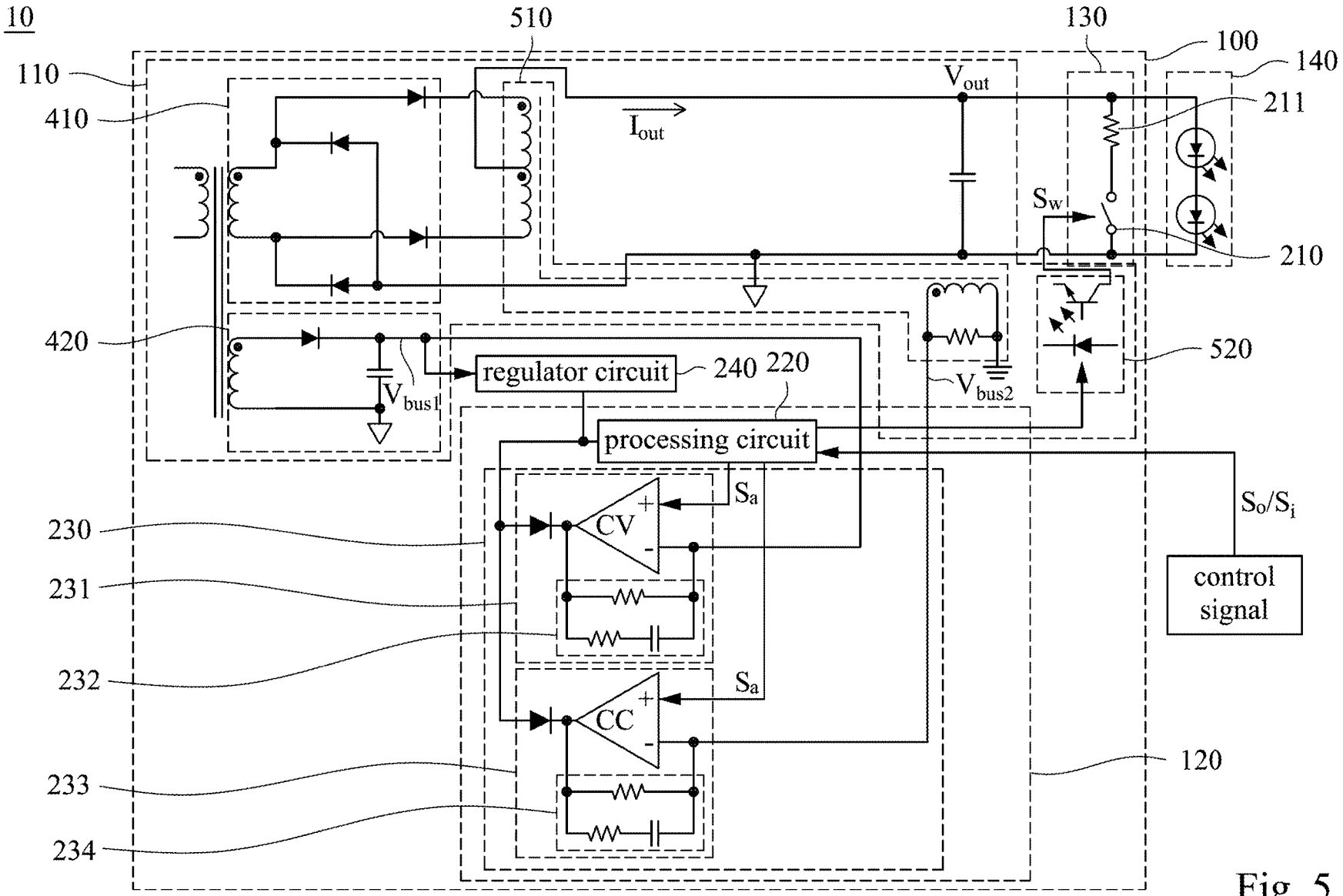
FIG. 5 shows a circuit diagram of the third type of the driver according to some embodiments of the present disclosure.

Referring to FIG. 5, FIG. 5 is a circuit diagram of the third type of the driver according to some embodiments of the present disclosure. In this example, the conversion circuit 110 further includes a first isolation circuit 510 and a second isolation circuit 520.

In some embodiments, the control circuit 120 senses the output current $I_{out}$ via the first isolation circuit 510, and compares the current indicated by the control signal with the sensed output current $I_{out}$ (e.g., by using the second operational circuit 233) to adjust the output current $I_{out}$. The first isolation circuit 510 can be a pair of auxiliary windings. In addition, the control circuit 120 senses the output voltage $V_{out}$ via the second secondary winding 420, and compares the voltage indicated by the control signal with the sensed output voltage $V_{out}$ (e.g., by using the first operational circuit 231) to adjust the output voltage $V_{out}$. Therefore, with the configuration of the pair of auxiliary windings and the second secondary winding 420, interference from noise(s) on the output voltage $V_{out}$ and the output current $I_{out}$ can be reduced, and thus sensing of the control circuit 120 can be more accurate.

Similarly, the control circuit 120 can transmit the switching signal to the bypass circuit 130 (e.g., switch 210) via the second isolation circuit 520. The second isolation circuit 520 can be an optical coupler.

As described above, the driver and the control method in embodiments of the present disclosure are able to supply power to a microprocessor by the output voltage directly or the coupling output voltage without employing additional circuits. The low power consumption of the standby mode can be achieved by simple circuit operations, and thus reducing the complexity and cost of the overall circuit.

Although the present disclosure has been disclosed in the above embodiments, it is not intended to limit the disclosure. Anyone who is familiar with the art can make various changes and refinements without departing from the spirit and scope of the disclosure. Therefore, the scope of protection of this disclosure is attached. The scope defined in the scope of application for patent application shall prevail.

What is claimed is:

1. A driver for driving a load unit, the driver comprising:

a conversion circuit configured to convert an input voltage into an output voltage, wherein the load unit is coupled to the conversion circuit to receive the output voltage and an output current;

a bypass circuit electrically coupled between the conversion circuit and the load unit; and a control circuit configured to control the output current to flow through the load unit to drive the load unit in a driving mode, and to control the output current to flow through the bypass circuit in a standby mode, wherein the output current in the standby mode is lower than the output current in the driving mode, the control circuit comprises a processing circuit and an adjustment circuit, the processing circuit is configured to generate a voltage adjustment signal and a current adjustment signal, the adjustment circuit is configured to receive a voltage on a first power line and the voltage adjustment signal so as to adjust the output voltage, and is configured to receive a voltage on a second power line and the current adjustment signal so as to adjust the output current.

2. The driver of claim 1, wherein the bypass circuit comprises:

a resistor coupled to a first end of the load unit; and a switch coupled to the resistor in series and coupled to a second end of the load unit, wherein in the standby mode, the switch is turned on according to a switching signal so that the output current flows through the resistor.

3. The driver of claim 2, wherein in the driving mode, the switch is turned off according to the switching signal so that the output current does not flow through the resistor.

4. The driver of claim 1, wherein:

the processing circuit is configured to selectively enter the driving mode or the standby mode according to a control signal, to generate the voltage adjustment signal and the current adjustment signal, and to generate a switching signal to the bypass circuit; and the adjustment circuit is coupled to the processing circuit, and is configured to adjust the output voltage according to the voltage adjustment signal, and to adjust the output current according to the current adjustment signal.

5. The driver of claim 4, wherein the adjustment circuit comprises:

a first operational amplifier comprising:

a first end configured to receive the voltage adjustment signal;

a second end configured to receive the output voltage; and an output end coupled to the second end of the first operational amplifier; and a second operational amplifier comprising:

a first end configured to receive the current adjustment signal;

a second end configured to receive the output current; and an output end coupled to the second end of the second operational amplifier.

6. The driver of claim 1, further comprising:

a regulator circuit configured to regulate the output voltage to generate a supply voltage for powering on the control circuit, wherein in the standby mode, the control circuit lowers the output voltage but not to zero.

7. The driver of claim 1, wherein the conversion circuit further comprises a first isolation circuit and a second isolation circuit, and the control circuit senses the output current via the first isolation circuit, and outputs a switching signal to the bypass circuit via the second isolation circuit.

8. The driver of claim 1, wherein in the standby mode, the control circuit lowers the output voltage but not to zero and the output current does not flow through the load unit.

9. A control method for a load unit, comprising:

providing, by a conversion circuit, an output current and an output voltage;

selectively operating, by a control circuit, the load unit to be in a driving mode or in a standby mode according to a control signal;

in the driving mode, controlling the output current to flow through the load unit, so as to drive the load unit; and in the standby mode, controlling the output current to flow through a bypass circuit connected in parallel with the load unit, wherein the output current in the standby mode is lower than the output current in the driving mode, the control circuit comprises a processing circuit and an adjustment circuit, the processing circuit is configured to generate a voltage adjustment signal and a current adjustment signal, the adjustment circuit is configured to receive a voltage on a first power line and the voltage adjustment signal so as to adjust the output voltage, and is configured to receive a voltage on a second power line and the current adjustment signal so as to adjust the output current.

10. The control method of claim 9, wherein in the standby mode, controlling the output current to flow through the bypass circuit comprises:

turning on a switch of the bypass circuit according to a switching signal, so that the output current flows through the bypass circuit rather than the load unit.

11. The control method of claim 9, wherein in the standby mode, controlling the output current to flow through the bypass circuit comprises:

generating the voltage adjustment signal and the current adjustment signal according to the control signal; and lowering the output voltage according to the voltage adjustment signal and lowering the output current according to the current adjustment signal.

12. The control method of claim 9, further comprising:

in the standby mode, lowering, by the control circuit, the output voltage but not to zero; and regulating, by a regulator circuit, the output voltage to generate a supply voltage for powering on the control circuit.

13. An illumination system, comprising:

a driver configured to drive the illumination unit, the driver comprising:

a conversion circuit configured to convert an input voltage into an output voltage, wherein the illumination unit is coupled to the conversion circuit to receive the output voltage and an output current;

a bypass circuit electrically coupled between the conversion circuit and the illumination unit; and a control circuit configured to control the output current to flow through the illumination unit to drive the illumination unit in a driving mode, and to control the output current to flow through the bypass circuit in a standby mode, wherein the output current in the standby mode is lower than the output current in the driving mode, the control circuit comprises a processing circuit and an adjustment circuit, the processing circuit is configured to generate a voltage adjustment signal and a current adjustment signal, the adjustment circuit is configured to receive a voltage on a first power line and the voltage adjustment signal so as to adjust the output voltage, and is configured to receive a voltage on a second power line and the current adjustment signal so as to adjust the output current.

14. The illumination system of claim 13, wherein the bypass circuit comprises:

a resistor coupled to a first end of the illumination unit; and a switch coupled to the resistor in series and coupled to a second end of the illumination unit, wherein in the standby mode, the switch is turned on according to a switching signal, so that the output current flows through the resistor.

15. The illumination system of claim 14, wherein in the driving mode, the switch is turned off according to the switching signal, so that the output current does not flows through the resistor.

16. The illumination system of claim 13, wherein:

the processing circuit is configured to selectively enter the driving mode or the standby mode according to a control signal, to generate the voltage adjustment signal and the current adjustment signal, and to generate a switching signal to the bypass circuit; and the adjustment circuit is coupled to the processing circuit, and is configured to adjust the output voltage according to the voltage adjustment signal, and to adjust the output current according to the current adjustment signal.

17. The illumination system of claim 16, wherein the adjustment circuit comprises:

a first operational amplifier comprising:

a first end configured to receive the voltage adjustment signal;

a second end configured to receive the output voltage; and an output end coupled to the second end of the first operational amplifier; and a second operational amplifier comprising:

a first end configured to receive the current adjustment signal;

a second end configured to receive the output current; and an output end coupled to the second end of the second operational amplifier.

18. The illumination system of claim 13, further comprising:

a regulator circuit configured to regulate the output voltage to generate a supply voltage for powering on the control circuit, wherein in the standby mode, the control circuit lowers the output voltage but not to zero.

19. The illumination system of claim 13, wherein the conversion circuit further comprises a first isolation circuit and a second isolation circuit, and the control circuit senses the output current via the first isolation circuit, and outputs a switching signal to the bypass circuit via the second isolation circuit.

20. The illumination system of claim 13, wherein the control circuit lowers the output voltage but not to zero in the standby mode, and the output current does not flow through the illumination unit.

* * * * *